US010378760B2

(12) United States Patent
Rousseau et al.

(10) Patent No.: US 10,378,760 B2
(45) Date of Patent: Aug. 13, 2019

(54) LEAN GAS BURNER

(71) Applicant: COGEBIO, Irigny (FR)

(72) Inventors: Louis Rousseau, Rochetaillee sur Saone (FR); Etienne Lebas, Seyssuel (FR); Christian Bedrossian, Pont-de-Cheruy (FR); Adrien Queuche, Lyons (FR)

(73) Assignee: Cogebio, Irigny (FR)

( * ) Notice: Subject to any disclaimer, the term of this patent is extended or adjusted under 35 U.S.C. 154(b) by 617 days.

(21) Appl. No.: 15/024,877

(22) PCT Filed: Oct. 6, 2014

(86) PCT No.: PCT/FR2014/052523
§ 371 (c)(1),
(2) Date: Mar. 25, 2016

(87) PCT Pub. No.: WO2015/055916
PCT Pub. Date: Apr. 23, 2015

(65) Prior Publication Data

US 2016/0238241 A1 Aug. 18, 2016

(30) Foreign Application Priority Data

Oct. 14, 2013 (FR) ..... 13 59968

(51) Int. Cl.

| | |
|---|---|
| ***F23D 14/22*** | (2006.01) |
| ***F23D 14/24*** | (2006.01) |
| ***F23C 6/04*** | (2006.01) |
| ***C10J 3/72*** | (2006.01) |
| ***F23D 14/58*** | (2006.01) |
| ***F23D 14/62*** | (2006.01) |
| ***F23N 1/00*** | (2006.01) |

(52) U.S. Cl.
CPC ..... *F23D 14/22* (2013.01); *C10J 3/72* (2013.01); *F23C 6/045* (2013.01); *F23D 14/24* (2013.01); *F23D 14/58* (2013.01); *F23D 14/62* (2013.01); *F23N 1/002* (2013.01); *C10J 2300/0916* (2013.01); *C10J 2300/1643* (2013.01); *F23C 2900/03004* (2013.01); *F23C 2900/06041* (2013.01); *F23D 2204/00* (2013.01); *F23D 2900/14002* (2013.01); *F23N 2037/08* (2013.01)

(58) Field of Classification Search
CPC . F23D 14/22; F23D 14/24; F23C 2900/03004
USPC ..... 431/37, 195, 201
See application file for complete search history.

(56) References Cited

U.S. PATENT DOCUMENTS 2,469,272 A * 5/1949 Logan ..... F23D 11/001 137/52
4,095,929 A * 6/1978 McCartney ..... F23D 14/22 239/404

(Continued)

FOREIGN PATENT DOCUMENTS

DE 2936970 A1 * 4/1981 ..... F23C 7/02
FR 2465158 A3 3/1981

(Continued)

*Primary Examiner* — Steven B McAllister
*Assistant Examiner* — Desmond C Peyton
(74) *Attorney, Agent, or Firm* — Jordan IP Law, LLC; Todd A. Vaughn

(57) ABSTRACT

A gas burner for burning a gas with a low calorific value. The gas burner may be for burning a synthesis gas issuing from the gasification of biomass.

19 Claims, 2 Drawing Sheets

(56) References Cited

U.S. PATENT DOCUMENTS

| | | | | |
|---|---|---|---|---|
| 4,295,821 | A * | 10/1981 | Schilling | F23D 11/402 431/353 |
| 7,249,721 | B2 * | 7/2007 | Niass | F23C 7/002 239/399 |
| 2004/0048211 | A1 * | 3/2004 | Martin | F23C 13/00 431/7 |
| 2006/0246387 | A1 | 11/2006 | Smirnov | |
| 2015/0137041 | A1 * | 5/2015 | Rousseau | C10J 3/26 252/373 |

FOREIGN PATENT DOCUMENTS

| | | | | |
|---|---|---|---|---|
| FR | 2654191 | A1 * | 5/1991 | F23C 7/00 |
| FR | 2926872 | A1 * | 7/2009 | F23C 1/12 |
| WO | 01/07833 | A1 | 2/2001 | |

* cited by examiner

LEAN GAS BURNER

CROSS-REFERENCE TO RELATED APPLICATIONS

The present application is a National Stage Application of PCT International Application No. PCT/FR2014/052523 (filed on Oct. 6, 2014), under 35 U.S.C. § 371, which claims priority to French Patent Application No. 1359968 (filed on Oct. 14, 2013), which are each hereby incorporated by reference in their respective entireties.

TECHNICAL FIELD

Embodiments relate to the field of industrial gas burners, more particularly, gas burners suitable for the combustion of lean gases.

BACKGROUND

There exists a need for burners for gasses with a low calorific value. These are usually recovered gasses coming from industrial processes (blast furnace, biogas, gas from discharges, gas issuing from various gasification processes, furnace gases containing VOCs, etc.), the calorific value of which is low because of their high concentration of inert gas. This is the case with certain types of synthesis gas. "Synthesis gas" (or "syngas") means a mixture of $CO/H_2$ issuing from the gasification of carbonaceous substances in the presence of steam and/or air, optionally enriched with oxygen. In particular, the synthesis gas obtained from the conversion of biomass in a gasifier without oxygen enrichment has a much lower calorific value than that of fossil fuels (in particular propane and butane gases); this is a "gas with a low calorific value".

"Lean gas" or "gas with a low calorific value" means a gas with a calorific value (NCV) of less than 3000 Kcal/m3.

Moreover, these gases of various origins, such as synthesis gas issuing from biomass, often contain tars and particles. Because of this, use thereof in the burners normally used for fossil fuels is generally not possible, and it is necessary to develop specific burners for synthesis gas (or other lean gases). Such specific burners exist, but are complex in design.

In particular, French Patent No. FR 2 889 292 describes a burner for a lean combustible gas of the type comprising a combustion nose on a central axis and means for supplying a mixture of combustible gas and combustion air in rotation about the central axis of the burner. The burner is distinguished in that it is configured so as to inject, in front of the combustion nose, a flow of non-flammable pre-mixture containing a mixture of premixed air and combustible gas, a complementary flow so as to reach a flammability threshold of the mixture in front of the combustion nose, said flow being ejected at the centre of the pre-mixture flow by means of a central complementary air flow and/or around the pre-mixture flow by means of a peripheral complementary air flow. This configuration has complexity of assembly and adjustment of the means used with the additional drawback, if the lean gas contains tars and particles, of gradual fouling of the equipment, in particular in the pre-mixture zone before ignition of the fuel.

European Patent No. EP 1 800 062 describes a burner for the combustion of a gas with a low calorific value, comprising a channel extending along an axis of the burner, for the supply of combustion air, and a channel for the combustible gas, which is designed for a large flow, in terms of volume, of combustible gas with a low calorific value, the channel for the gas and the channel for the air emerging in a mixture zone. The channel for the air has an orifice zone immediately adjacent (in flow technology) to the mixture zone, and a swirling element, for producing turbulent combustion air, is provided in the orifice zone and swirling fins are disposed in the channel for the air upstream of the swirling element. Because of its configuration, this burner does not minimise the production of nitrogen oxides, and there exist risks of pulsing of the flame. In addition, it is not suitable for gases containing tars since the tars are liable to condense on the cold wall of the pipe and the pipe introducing the lean gas is sensitive to fouling (annular zone). The mixture of air and lean gas is no doubt fairly non-uniform.

The subject matter of U.S. Pat. No. 7,003,957 is a synthesis-gas burner. The combustible gas is injected through holes inclined in the radial direction towards the centre of the combustion chamber, and having a diameter D and an injection angle alpha. These holes are placed at the discharge from the burner, namely at the end of the swirling space. The diameter D and the angle alpha are specific parameters that are chosen suitably by a person skilled in the art according to different variables (specific gas composition, emissions, etc.). This burner is very sensitive to fouling since the lean gas is injected through holes, and because of this the burner is not suitable for the presence of tars in the lean gas. It is a burner without a pilot flame, which poses a problem for ensuring combustion stability. Because of its configuration, this burner certainly produces a great deal of nitrogen oxides, and there exist risks of pulsing of the flame.

In addition, the European Patent No. EP 0 008 842 describes a burner capable of simultaneously burning several gaseous fuels with different calorific values. The burner for multiple gaseous fuels uses forced-draft preheated air, and comprises a cylindrical inner burner tube, means being provided for injecting, through the upstream end, combustion air preheated to a selected temperature and compressed to a chosen pressure. The downstream end of the inner burner tube is closed, and a plurality of longitudinal slots are spaced apart circumferentially in the wall of the tube at the closed end. Means are provided for injecting a rich combustible gas at a chosen pressure in the inner burner tube along its axis. An outer burner tube axially surrounds the inner burner tube and forms an annular passage. Means are also provided to pass a lean combustible gas at low pressure through the annular passage and outside through a peripheral slot at the end of the outer burner tube inside the furnace. This burner is very sensitive to fouling since the lean gas is injected through holes, and the burner is not suited to the presence of tars in the lean gas. It is a burner without a pilot flame, which poses problems for ensuring stability of combustion. Because of its configuration, this burner certainly produces a great deal of nitrogen oxides, and there exist risks of pulsing of the flame. Thus burner produces a flat flame, without the possibility of extending it, which destines it for specific furnaces.

European Patent No. EP 0 780 630 B1 (Alstom) describes a burner comprising a swirler followed by a tube, this tube itself being followed by the combustion chamber proper (in the direction of gas flow). The junction zone between the tube and the combustion chamber (referred to as "A" in the description of the patent) has a particular form that enables a "detachment edge" to be formed, the role of which is to stabilise a reflux zone. This reflux zone fulfils the role of a "flame attacher." This burner is very sensitive to fouling since the lean gas is injected through holes, and the burner is not suited to the presence of tars in the lean gas. It is a burner without a pilot flame, which poses problems for ensuring combustion stability. Because of its configuration, this burner certainly produces a great deal of nitrogen oxides, and there exist risks of pulsing of the flame.

The applicant has found that the existing burners suitable for the combustion of synthesis gas are complex, difficult to adjust and to operate, and generally subject to fouling. There therefore exists a need for a lean-gas burner of simple design that is simple to manufacture and of low cost, reliable, easy to adjust, and not requiring any or only a little maintenance.

SUMMARY

A first aim of the invention is to provide an industrial burner suitable for the combustion of lean gas, that is to say having a low NCV (net calorific value) and the NCV of which may be variable according to the composition of the feed gas. In some cases, this lean gas is also available at a high temperature (up to 600° C.). The lean gas may in addition contain tars and solid particles. It is therefore necessary to have a burner in which it is possible to achieve a good air/fuel mixture without any obstacle to flow in order to avoid fouling of said obstacles.

Another aim of the invention is to provide a lean-gas burner, and in particular for a synthesis gas obtained from the gasification in air of biomass, which can replace a burner already existing in an installation. In particular, the synthesis-gas burner must have a design such that it is possible to adjust the length and/or diameter of the flame according to the shape of the existing combustion chamber with which it is associated.

These aims are achieved by means of a gas burner for burning a gas with a low calorific value, such as synthesis gas issuing from the gasification of biomass, the burner being substantially cylindrical in shape, and comprising a first annular zone formed between the external wall of the burner and an internal wall of the burner substantially parallel to the external wall, and a second annular zone formed between the external wall of the burner and the internal wall downstream of the first zone, and the burner comprising moreover a pipe for supplying gas with a low calorific value substantially parallel to the axis of the burner, a primary-air supply pipe formed in the external wall and emerging in the first annular zone, a secondary-air supply pipe formed in the external wall and emerging in the second annular zone, an annular slot for introducing primary air from the first annular zone into the combustion zone, said annular slot being formed between the external wall and the upstream end of the internal wall, orifices for introducing secondary air from the second annular zone into the combustion zone, said orifices being pierced in the internal wall, said burner further being distinguished by the fact that the annular slot has a form such that the primary air is supplied to the combustion zone in the form of a conical sheet of air, and creates a compression zone, the orifices are disposed so as to allow swirling of the secondary air. This burner represents a first subject matter of the invention.

In an advantageous embodiment of the burner according to the invention, the annular slot is formed by means of a so-called "air introduction" piece situated at the upstream end of the internal wall of the burner. This air-introduction piece has a lip shape; more precisely it has a conical part divergent from downstream to upstream forming with the internal wall of the burner an angle $\alpha$ of between 20° and 45°, and a so-called "suction face" part terminating on a trailing edge that directs said annular sheet of air that has become conical according to the required profile in order to constitute a compression zone situated on the axis of the burner. The compression zone comes into contact with the lean-gas flow in order to allow a good air/fuel mixture.

Preferably, the air-introduction piece has a flat upstream edge perpendicular to the axis of the burner and substantially parallel to a flat surface of the external wall of the burner, thus creating an air flow erected perpendicular to the axis of the burner.

In a preferred embodiment of the burner according to the invention, the conical part of the air-introduction piece is followed by a part rounded according to a radius of curvature r1, itself followed by a flat upstream edge, and the suction-face part follows the flat upstream edge, and is formed by a first part rounded according to a radius of curvature r2 followed by a second part consisting of three successive flat profiles forming respective angles $\beta$1, $\beta$2 and $\beta$3 with the plane of the upstream edge, the angles $\beta$1, $\beta$2 and $\beta$3 being respectively between 30° and 80°.

In a preferred embodiment, the orifices for entry of the secondary air are cylindrical or oblong in cross section, and are distributed in the part of the internal wall of the burner facing the area where the secondary air is introduced and have a unit diameter of between 3 and 15 mm, so as to allow the introduction of the secondary air at a speed of between 10 and 50 m/s.

Furthermore, in a preferred embodiment, the axes of the secondary-air inlet orifices are inclined at angles of between 15° and 40°, and preferably substantially equal to 25°, with respect to the plane perpendicular to the axis of the burner. Preferably, the axes of the orifices are also inclined at angles of between 10° and 25°, and preferably substantially equal to 15°, with respect to the radius of the cylinder formed by the burner and passing through the orifice, so as to allow optimum swirling of the secondary air.

Yet another aim of the invention is to be able to supply the burner with an addition of fossil fuel to increase the NCV where necessary, or to increase the total power supplied, and/or to be able to have a pilot flame supplied with a fossil fuel. These aims are achieved by virtue of the presence of at least one fossil-fuel introduction pipe. In addition, the pilot flame provides security of the main flame.

Yet another aim of the invention is to allow a functioning with a substitute fossil fuel at 100% of the nominal power. The burner can in fact function only with a supply of fossil fuel. This operating mode may be useful in the case of a break in the lean-gas supply.

In a preferred embodiment, the burner according to the invention comprises a control means comprising a memory and regulating the flow of air introduced for each combustion rate and each ratio between lean gas and fossil fuel, according to working points parameterised and stored in memory.

Another aim of the invention is to reduce the temperature of the internal wall of the burner so as to limit its thermal fatigue. Yet another aim of the invention is to reduce the temperature of the external wall of the burner so as to limit the need for thermal insulation. Yet another aim of the invention is to preheat the primary air and the secondary combustion air so as to improve the quality of combustion. These aims are achieved by means of the burner according to the invention, because of the presence of the first and second annular zones formed between the external wall and the internal wall of the burner and which allow circulation of the primary air and the secondary air in the incoming air being at ambient temperature, namely around 20° C.

Another subject matter of the invention is the use of the burner according to the invention in furnaces, boilers or dryers.

Yet another subject matter of the invention is an installation comprising a burner according to the invention, associated with a biomass gasifier.

DRAWINGS

FIG. 1 illustrates a front view of the burner according to the invention.

FIG. 2 illustrates a view of the burner according to the invention in cross-section along the plane A-A in FIG. 1.

FIG. 3 illustrates an enlarged view of detail B in FIG. 2.

DESCRIPTION

Figure 1:
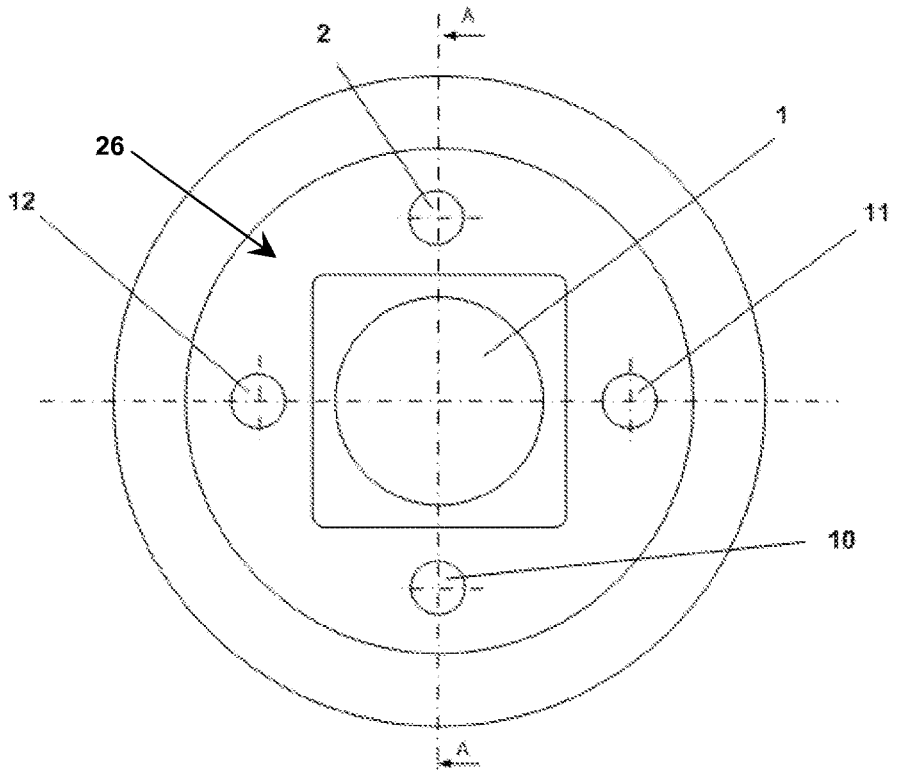
FIGS. 1, 2 and 3 illustrate an embodiment of the burner according to the invention.

The burner according to the invention was developed for the combustion of lean gas, and in particular synthesis gas (or syngas) issuing from the gasification of biomass.

The burner according to the invention combines two air flows for staged combustion. Staged combustion consists of introducing either the combustion air or the fuel into the flame at different steps. During the staged combustion by staging of air, part of the combustion air, typically around 5% to 50%, is supplied to a primary combustion zone with the whole of the fuel. In this way a fuel-rich zone is obtained and the formation of nitrogen oxides is reduced. The rest of the air is injected further downstream, forming a secondary flame zone, where combustion is completed. In the burner according to the invention, the primary and secondary air flows are formed as follows:

an axial primary air flow that makes it possible to attach the flame for any type of gaseous fuel: synthesis gas, natural gas and propane;

a rotary secondary air flow that stabilises the flame without having recourse to supplementary equipment subject to fouling.

Thus, the stability of the flame in the burner according to the invention is effective at all combustion rates by virtue of the combination of the axial and rotary modes of the primary and secondary oxidising air flows respectively.

Furthermore, this combustion mode makes it possible to vary the relative contribution of the various fuels, in particular the synthesis gas, the natural gas and the propane, according to the power sought and the availability of said fuels. The burner may take a mixed supply of lean gas/fossil fuel in variable proportions from 100% lean gas to 100% fossil fuel.

It is known that the quality of the combustion, measured in particular by the quality of unburnt residues and pollutants emitted, depends on the quality of the air/fuel mixture. More precisely, it is important to achieve an air/fuel mixture that is as uniform as possible in order to limit hot spots and thus minimise the formation of nitrogen oxides. Furthermore, the staged combustion used in the burner according to the invention also requires a rapid mixing of the fuel and air. Various devices are used in existing burners to improve the quality of the mixing, such as deflectors, fins, perforated plates or impact plates ("impact plate" means a screen placed perpendicular to the flow in its axial part). All these devices have the drawback of creating an obstacle to the flow and are consequently sensitive to fouling. One advantage of the burner according to the invention is that it affords an optimum air/fuel mixture while presenting no obstacle to flow. The quality of the mixing is ensured in particular by the particular form of the primary air flow. The annular slot has a form such that the primary air is supplied to the combustion zone in the form of a conical sheet of air taking over or entraining the flows of fuel (lean gas and fossil fuel).

The burner according to the invention was designed to be able to burn mainly a lean gas and more particularly synthesis gas issuing from the gasification of biomass. However, in an advantageous embodiment, the burner according to the invention is also suitable for burning a traditional fuel such as natural gas, propane, or even domestic fuel oil. The burner according to the invention is therefore a mixed burner that can function either with synthesis gas, natural gas or propane or with a mixture of these various fuels (especially with a mixture of synthesis gas and fossil fuels). Furthermore, its particular design confers on it great flexibility of use, with possible change from functioning with 100% fossil fuel to functioning with 100% lean gas, in particular gas issuing from the conversion of biomass.

At all combustion rates the quantity of oxidising air is adjusted to the mixture of fuels that is taken by the burner. Advantageously, this adjustment is achieved by virtue of a control means, such as an automatic controller which makes it possible to supply a flow of air calculated for each combustion rate and for each ratio between lean gas and fossil fuel, according to working points parameterised and stored in memory. In a particular embodiment, a lambda sensor also measures the oxygen content of the combustion fumes, which makes it possible to refine the adjustment of the flow of oxidising air. Preferably, the air flow rate is adjusted globally (total primary air and secondary air flow).

Advantageously, the burner according to the invention is equipped with a pilot burner for flame lighting and safety. The pilot flame is obligatory in certain cases for safety reasons (EN 746-2).

One embodiment of the burner according to the invention is described below in relation to FIGS. 1, 2 and 3. The burner according to the invention has a substantially cylindrical shape. It has an external wall 16, and an internal wall 17 separated from the wall 16 in order to form annular zones 5 and 8. These zones 5 and 8 are separated from each other by a partition 20. The first annular zone 5 is used for introducing primary air into the combustion zone 7. The second annular zone 8 is used for introducing secondary air into the combustion zone 7. The second annular zone 8 is used for introducing secondary air into the combustion zone 7.

Figure 2:
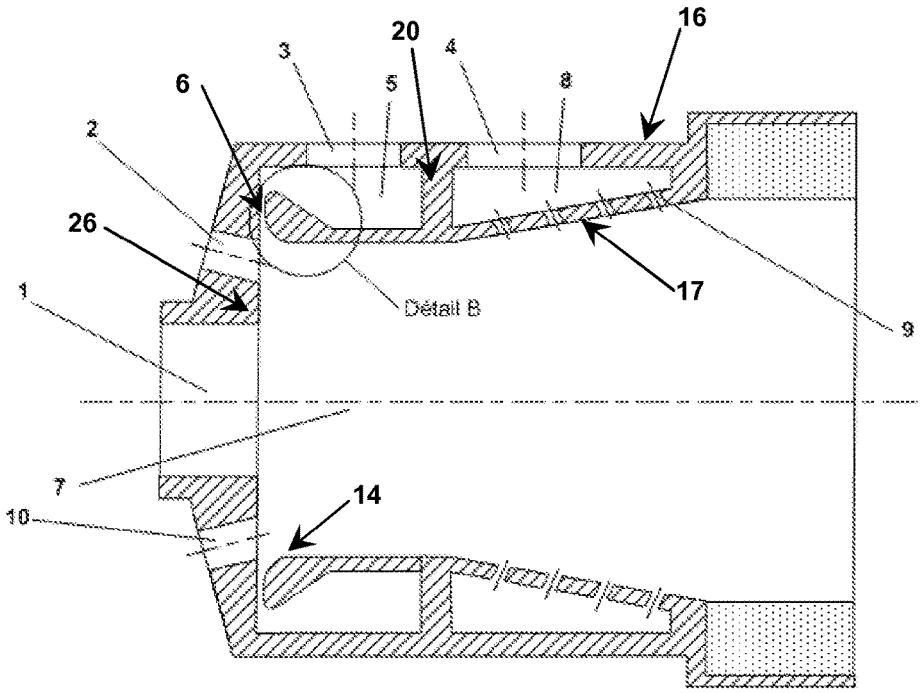

With reference to FIGS. 1 and 2, a pipe 1 enables lean gas to be introduced into the burner. Preferably, the pipe 1 introducing lean gas is cylindrical, and its diameter is calculated according to the quantity of lean gas to be accepted. The speed of introduction of lean gas into the burner is generally between 5 and 30 m/s, and preferable between 15 and 25 m/s.

A pipe 2 enables fossil fuel (natural gas, propane or domestic fuel oil in particular) to be introduced. The pipe 2 introducing fossil fuel is preferably cylindrical. Its diameter is calculated according to the quantity of fuel gas to be accepted. The speed of introducing fossil fuel into the burner is between 5 and 30 m/s (preferably between 15 and 25 m/s). In the case of a liquid fuel (domestic fuel oil), this is atomised by a specific injector (not shown).

A pipe 3 makes it possible to introduce primary air into the annular zone 5. The primary air introduced into the annular zone through the pipe 3 is then directed to an annular slot 6 which has a form such that it creates a conical sheet of air and a compression zone in the zone 7. It is this specific configuration of the burner according to the invention that affords a good mixing of the primary air with the fuel.

The speed of the primary air is 20 to 200 m/s at the lip or annular slot 6. The flow of primary air takes place in laminar mode.

Preferably, the air-introduction piece 14 has a flat upstream edge 19 perpendicular to the axis of the burner and substantially parallel to a flat surface of the external wall 16 of the burner, thus creating an air flow erected perpendicular to the axis of the burner. The profile of the air-introduction piece 14 takes over the air flow in order to direct it, without modification of its laminar mode, to a zone situated substantially on the axis of the burner.

The conical sheet of air is intended mainly to produce a good air/fuel mixture, but it also protects the inner wall of burner, in particular in the case where the lean gas contains tars and particles.

A pipe 4 enables secondary air to be introduced into the annular zone 8. The secondary air introduced into the annular zone 8 through the pipe 4 is directed to a set of injection orifices 9 for rotating and swirling the secondary air. The rotation of the secondary air makes it possible in particular to prevent detachment of the flame at high power. It also helps to avoid pulsing of the flame responsible for vibratory phenomena which otherwise could occur at certain powers and for certain air/fuel ratios.

The orifices 9 are orifices with a cylindrical or oblong cross section. The orifices 9 for introducing secondary air pierced in the internal wall 17 of the burner preferably have a unit diameter of 3 to 15 mm, thus allowing the injection of secondary air at speeds of between 10 and 50 m/s and preferably between 20 and 40 m/s.

Preferably, the internal wall 17 of the burner has a divergent conical form (i.e. broadening downstream) in its downstream part, at the secondary-air introduction zone. The orifices 9 are distributed in the conical part of the internal wall 17 of the burner. Preferably, the axes of the orifices 9 are inclined at angles of between 15° and 40°, and preferably substantially equal to 25°, with respect to the plane perpendicular to the axis of the burner. Preferably, the axes of the orifices 9 are also inclined at angles of between 10° and 25° and preferably substantially 15° with respect to the "radius of the cylinder formed by the burner and passing through the orifice", so as to allow optimum swirling of the secondary air.

The compression zone generally consists of a straight-line segment situated substantially on the axis of the burner.

The compression zone is obtained by the flow of air in laminar mode, the path of which is straightened up by the profile of the lip (as a "suction face"). The straightened-up annular sheet of air forms a cone, the thickness of which increases as the vertex is approached.

The passages 10, 11 and 12 depicted in FIG. 2 enable a conventional ignition member to be installed, such as an ionisation probe or a burner creating a pilot flame (not shown) or a flame detector. The passages 10, 11 and 12 may also serve to install one or more supplementary fossil-fuel inlets to enable the burner according to the invention to function with this type of fuel over a wide power range. These passages are not limited in number. Depending on the power of the burner, it is possible to imagine more passages for supplying fossil fuels, a pilot flame and/or a flame detector.

Figure 3:
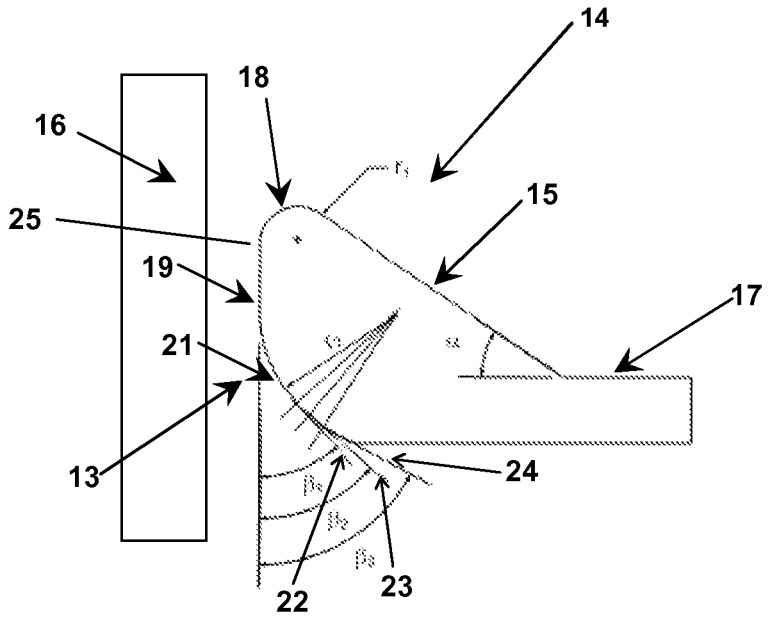

Detail B in FIG. 1 is presented in detail in FIG. 3. It depicts a particular form of the annular slot 6 enabling primary air to be introduced into the combustion zone in the form of a conical sheet. The shape of the annular slot 6 depicted in FIG. 3 has been designed so as to minimise pressure drops.

In the embodiment in FIG. 3, the annular slot 6 proper is formed by the space between a piece 14 referred to as the "primary-air introduction piece" in the burner, and the "bottom" of the external wall 16 of the burner. The primary-air introduction piece 14 is positioned at the upstream end 25 of the internal wall 17 of the burner. The primary-air introduction piece 14 is preferably formed in a single piece with the internal wall 17.

The primary-air introduction piece 14 has a conical part 15 diverging from downstream to upstream forming with the internal wall 17 of the burner an angle $\alpha$, the conical part 15 creating a sheet of air. The angle $\alpha$ is between 20° and 45°. The conical part 15 prevents a significant recirculation of air in the annular zone and thus limits the pressure drop. The conical part 15 is followed by a rounded part 18 with a radius of curvature r1, preferably lying between 3 and 15 mm. The rounded part 18 also limits the recirculations of air in the annular zone 5. In addition, sharp corners interfere with the circulation of air through the creation of turbulence micro-zones that increase the pressure drop, and this is why it is preferred to use a rounded part 18 rather than a right angle.

The rounded part 18 is itself followed by a flat upstream edge 19 substantially parallel to the "bottom" of the external wall 16 of the burner. This flat upstream edge is next followed by a part 13 having a so-called "suction face" form that directs the layer of air in the required profile, in order to constitute a compression zone on the axis of the burner. The suction face part 13 consists of a first part 21 rounded at a radius of curvature r2, preferably between 8 and 30 mm, followed by a second part consisting of three successive flat profiles 22, 23, 24 forming respective angles $\beta$1, $\beta$2 and $\beta$3 with the plane of the flat upstream edge 19, the angles $\beta$1, $\beta$2 and $\beta$3 preferably respectively aligned between 30° and 80°. These successive flat profiles gradually increase the radius of the suction face, so as to obtain a detachment of the stream of air at the end of the lip profile, or air-introduction piece 14. The angle $\beta$3 is greater than the angle $\beta$2, which is greater than the angle $\beta$1.

The burner according to the invention, in association with a gasifier and in particular in association with a biomass gasifier, allows total or partial replacement of a fossil fuel (fuel oil, natural gas, propane) by solid biomass for the production of heat. The fuels that can be used by way of biomass comprise in particular woodchips, ground pallets, wood granules and agricultural by-products.

The co-current fixed-bed gasifier described in the patent application WO 2013/098525 in the name of Cogebio is particular suitable for functioning in association with the burner according to the invention. This co-current fixed-bed gasifier comprises a reactor body, said reactor body comprising a top part and a bottom part, and the biomass is introduced through an inlet pipe situated in the top of the top part of the gasifier body, the synthesis gas is discharged through a synthesis-gas discharge pipe, and the ashes are discharged in the lower part of the bottom part of the reactor body through an ash discharge pipe; said gasifier comprises, from top to bottom: a biomass pyrolysis zone, a biomass oxidation zone, a reduction zone and a grille comprising a plurality of openings through which the ash passes in order to be discharged, and said gasifier also comprises means for introducing a gasification agent, such as air or oxygen, and said gasifier being characterised in that said means for introducing the gasification agent comprise: a gasification agent diffusion cone situated at the top of the oxidation zone of the gasifier and above said oxidation zone, and gasification agent injection means situated in the oxidation zone of the gasifier.

Furthermore, the majority of industrial burners integrated in furnaces, boilers or dryers can be replaced by a burner according to the invention in a power range from 500 to 2000 kW.

LIST OF REFERENCE NUMERALS

1 Pipe for introducing lean gas
2 Pipe for introducing fossil fuel
3 Primary-air inlet pipe
4 Secondary-air inlet pipe
5 Annular zone for the primary air
6 Slot
7 Combustion chamber
8 Annular zone for the secondary air
9 Secondary-air injection orifices
10,11,12 Additional passages allowing the "implantation" of an ignition member or a fossil-fuel inlet
13 Suction-face form of the "slot" 6 (primary-air inlet to the burner)
14 Primary-air introduction piece
15 Conical part of the piece
16 Cylindrical external wall of the burner
17 Internal wall of the burner
18 Rounded part according to a radius of curvature r1 of the piece 14
19 Flat upstream edge of the piece 14 (forming the annular slot in cooperation with the wall 16)
20 Separation between the primary-air inlet 5 and secondary air 8 zones
21 Part rounded according to r2
22,23,24 Successive flat profiles forming a respective angle β1, β2, β3 with the part 19
25 Upstream end of the internal wall 17
26 Base of the cylinder formed by the external wall

What is claimed is:

1. A gas burner for burning a gas having a low calorific value, the gas burner comprising:

a cylindrical body having:

a first annular zone formed between an external wall thereof and an internal wall thereof, and which extends substantially parallel to the external wall wherein the external wall has a base at an upstream distal end thereof;

a second annular zone formed downstream of the first zone between the external wall and the internal wall, wherein the first annular zone is separated from the second annular zone by a partition;

a first opening formed in the base, to supply the gas, and which extends substantially parallel to a longitudinal axis of the cylindrical body;

a second opening to supply primary air, and which is formed in the external wall in fluidic communication with the first annular zone;

a third opening to supply secondary air, and which is formed in the external wall in fluidic communication with the second annular zone;

an annular slot to introduce the primary air from the first annular zone into a combustion zone, the annular slot being formed between the external wall and an upstream end of the internal wall, and formed such that the primary air is supplied to the combustion zone in the form of a conical sheet of air, and creates a compression zone; and orifices formed in the internal wall to introduce the secondary air from the second annular zone into the combustion zone, and are disposed so as to allow swirling of the secondary air.

2. The gas burner of claim 1, wherein the cylindrical body further has an air-introduction piece which defines the annular slot, and which is situated at the upstream end of the internal wall.

3. The gas burner of claim 2, wherein the air-introduction piece has a conical part diverging from downstream to upstream, to form with the internal wall an angle α of between 20° and 45°, and a suction surface part terminating on a trailing edge, which is to direct the conical sheet of air according to a required profile in order to constitute a compression zone situated substantially on the longitudinal axis of the cylindrical body.

4. The gas burner of claim 3, wherein the air-introduction piece has a flat upstream edge perpendicular to the longitudinal axis of the cylindrical body and substantially parallel to a flat surface of the external wall, to thereby form an air flow extending perpendicular to the longitudinal axis of the cylindrical body.

5. The gas burner of claim 3, wherein the conical part is followed by a rounded part having a first radius of curvature, and which is followed by a planar upstream edge substantially perpendicular to the internal wall, and substantially parallel to the base of the cylindrical body formed by the external wall.

6. The gas burner of claim 5, wherein the suction surface part follows the planar upstream edge and is formed by a first rounded part having a second radius of curvature followed by a second part having a plurality of successive flat profiles forming respective angles with the plane of the upstream edge.

7. The gas burner of claim 5, wherein the angles are respectively between 30° and 80°.

8. The gas burner of claim 1, wherein the orifices have a cylindrical or oblong cross-section, and have a unit diameter of between 3 and 15 mm.

9. The gas burner of claim 1, wherein the base has a fourth opening to introduce a fossil fuel.

10. The gas burner of claim 1, wherein the base has passages to equip the gas burner with an ignition burner, a pilot flame or a flame detector.

11. The gas burner of claim 1, further comprising a controller having a memory, and which is to regulate the flow of air introduced for each combustion rate and each ratio of lean gas to fossil fuel according to working points parameterised and stored in the memory.

12. The gas burner of claim 1, wherein the orifices have axes that are inclined at an angle substantially equal to 25° with respect to the plane perpendicular to the longitudinal axis of the burner.

13. The gas burner of claim 1, wherein the orifices have axes that are inclined at an angle substantially 15° with respect to the radius of the cylindrical body and passing through the orifice.

14. The gas burner of claim 1, wherein the gas burner is sized for a power of between 500 and 2000 kW.

15. The gas burner of claim 1, wherein the gas burner is used in furnaces, boilers, or dryers.

16. The gas burner of claim 15, wherein a speed of the primary air is 20 to 200 m/s at the annular slot.

17. The gas burner of claim 15, wherein a speed of introduction of lean gas in the gas burner is between 15 and 25 m/s.

18. A system, comprising:

a biomass gasifier; and a gas burner for burning a gas having a low calorific value, the gas burner including a cylindrical body having:

a first annular zone formed between an external wall thereof and an internal wall thereof, and which extends substantially parallel to the external wall, wherein the external wall has a base at an upstream distal end thereof;

a second annular zone formed downstream of the first zone between the external wall and the internal wall, wherein the first annular zone is separated from the second annular zone by a partition;

a first opening, formed in the base, to supply the gas, and which extends substantially parallel to a longitudinal axis of the cylindrical body;

a second opening to supply primary air, and which is formed in the external wall in fluidic communication with the first annular zone;

a third opening to supply secondary air, and which is formed in the external wall in fluidic communication with the second annular zone;

an annular slot to introduce the primary air from the first annular zone into a combustion zone, the annular slot being formed between the external wall and an upstream end of the internal wall, and formed such that the primary air is supplied to the combustion zone in the form of a conical sheet of air, and creates a compression zone; and orifices formed in the internal wall to introduce the secondary air from the second annular zone into the combustion zone, and are disposed so as to allow swirling of the secondary air.

19. A gas burner, comprising:

a gas burner body having:

an external wall and an internal wall defining a combustion zone, wherein the external wall further has a base at an upstream distal end thereof;

a partition extending from the external wall to the internal wall to define a first annular zone and a second annular zone formed downstream of the first zone;

a first opening, formed in the base, to supply a gas to the combustion zone;

a second opening formed in the external wall in fluidic communication with the first annular zone to supply primary air to the first annular zone;

a third opening formed in the external wall in fluidic communication with the second annular zone to supply secondary air to the second annular zone;

an annular slot formed between the external wall and an upstream end of the internal wall to introduce the primary air from the first annular zone into the combustion zone, the annular slot being formed to supply the primary air in the form of a conical sheet of air which forms a compression zone in the combustion zone; and orifices formed in the internal wall to introduce the secondary air from the second annular zone into the combustion zone, and are disposed to allow rotation and swirling of the secondary air.

* * * * *